US006283576B1

(12) United States Patent
Premnath et al.

(10) Patent No.: US 6,283,576 B1
(45) Date of Patent: Sep. 4, 2001

(54) VENTABLE INK JET PRINTHEAD CAPPING AND PRIMING ASSEMBLY

(75) Inventors: Karai P. Premnath; Paul F. Sawicki; William L. King, all of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/429,655

(22) Filed: Oct. 29, 1999

(51) Int. Cl.[7] ..... B41J 2/165
(52) U.S. Cl. ..... 347/29
(58) Field of Search ..... 347/29, 30, 35

(56) References Cited

U.S. PATENT DOCUMENTS

| | | | | |
|---|---|---|---|---|
| 4,638,337 | | 1/1987 | Torpey et al. | 347/65 |
| 4,679,059 | | 7/1987 | Dagna | 347/50 |
| 4,707,714 | * | 11/1987 | Rosenthal et al. | 347/29 |
| 4,855,764 | | 8/1989 | Humbs et al. | 347/31 |
| 4,863,717 | | 9/1989 | Keana | 424/9 |
| 5,146,243 | | 9/1992 | English et al. | 347/29 |
| 5,596,354 | * | 1/1997 | Murphy | 347/30 |

FOREIGN PATENT DOCUMENTS

| | | |
|---|---|---|
| EP 0 844 092 A2 | 5/1998 | (JP) . |
| EP 0 867 295 A2 | 9/1998 | (JP) . |
| EP 0 901 905 A2 | 3/1999 | (JP) . |

* cited by examiner

*Primary Examiner*—N. Le
*Assistant Examiner*—Shih-wen Hsieh
(74) *Attorney, Agent, or Firm*—Tallam I. Nguti

(57) ABSTRACT

A ventable capping and priming assembly is provided for capping a nozzle face of an ink jet printhead so as to enable sealed priming of the printhead, as well as venting of the printhead to relieve defect causing pressures therefrom during non-priming periods. The ventable capping and priming assembly includes a capping member including a sealing member for sealing engagement with the nozzle face of the ink jet printhead, and a capping member mounted to the capping member and including a priming recess and a vacuum path formed therein. Further, the ventable capping and priming assembly includes a venting path formed from an outside surface of the capping member, and through the capping member, into the priming recess for venting the nozzle face of the ink jet printhead being capped, thereby relieving the nozzle face of the ink jet printhead of defect causing capping pressures during non-priming periods.

18 Claims, 4 Drawing Sheets

VENTABLE INK JET PRINTHEAD CAPPING AND PRIMING ASSEMBLY

BACKGROUND OF THE INVENTION

The present invention relates generally to ink jet printers including printheads and, more particularly, to a ventable ink jet printhead capping and priming assembly that has an open position for relieving defect causing printhead capping pressures that build up when each such printhead is capped, and a closed position that allows for sealed priming of the printhead during periodic maintenance of the printhead.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice or nozzle until the current pulse has ceased and the bubble begins to collapse. At that stage, the ink within the channel retracts and separates from the bulging ink which forms a droplet moving in a direction away from the channel and towards a recording medium. The channel is then refilled by capillary action, drawing ink from a supply container.

One particular example of a type of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices or nozzles of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printers are described in, for example, U.S. Pat. Nos. 4,855,764 and 4,863,717, and the removal of gas from the ink reservoir of a printhead during printing is described in U.S. Pat. No. 4,679,059. All of these patents are hereby incorporated by reference.

A continuing problem with prior art capping mechanisms or assemblies is the slow build up of positive pressure within the sealed capping assembly during idle periods of the printer (with the printhead capped). Such positive pressure ordinarily and usually causes air and ink within the printhead orifices or nozzles to be pushed back into the printhead channels feeding the nozzles. This of course results undesirably in subsequent printhead priming difficulties, and print quality defects. This problem is further complicated by the need to have the capping assembly or mechanism be unvented and completely sealed during priming operations of the maintenance periods.

There is therefore a need for a ventable capping and priming assembly that can relieve defect causing printhead capping pressures that build up when each such printhead is capped, and that yet allows for sealed priming during periodic maintenance procedures.

SUMMARY OF THE INVENTION

In accordance with the present invention, there is provided a ventable capping and priming assembly for capping a nozzle face of an ink jet printhead so as to enable sealed priming of the printhead, as well as venting of the printhead to relieve defect causing pressures therefrom during non-priming periods. The ventable capping and priming assembly includes a cap member including a sealing member for sealing engagement with the nozzle face of the ink jet printhead, and a capping member mounted to the cap member and including a priming recess and a vacuum path formed therein. Further, the ventable capping and priming assembly includes a venting path formed from an outside surface of the capping member, and through the capping member, into the priming recess for venting the nozzle face of the ink jet printhead being capped, thereby relieving the nozzle face of the ink jet printhead of defect causing capping pressures.

BRIEF DESCRIPTION OF THE DRAWINGS

In the detail description of the invention presented below, reference is made to the drawings, in which.

DESCRIPTION OF THE INVENTION

Figure 1:
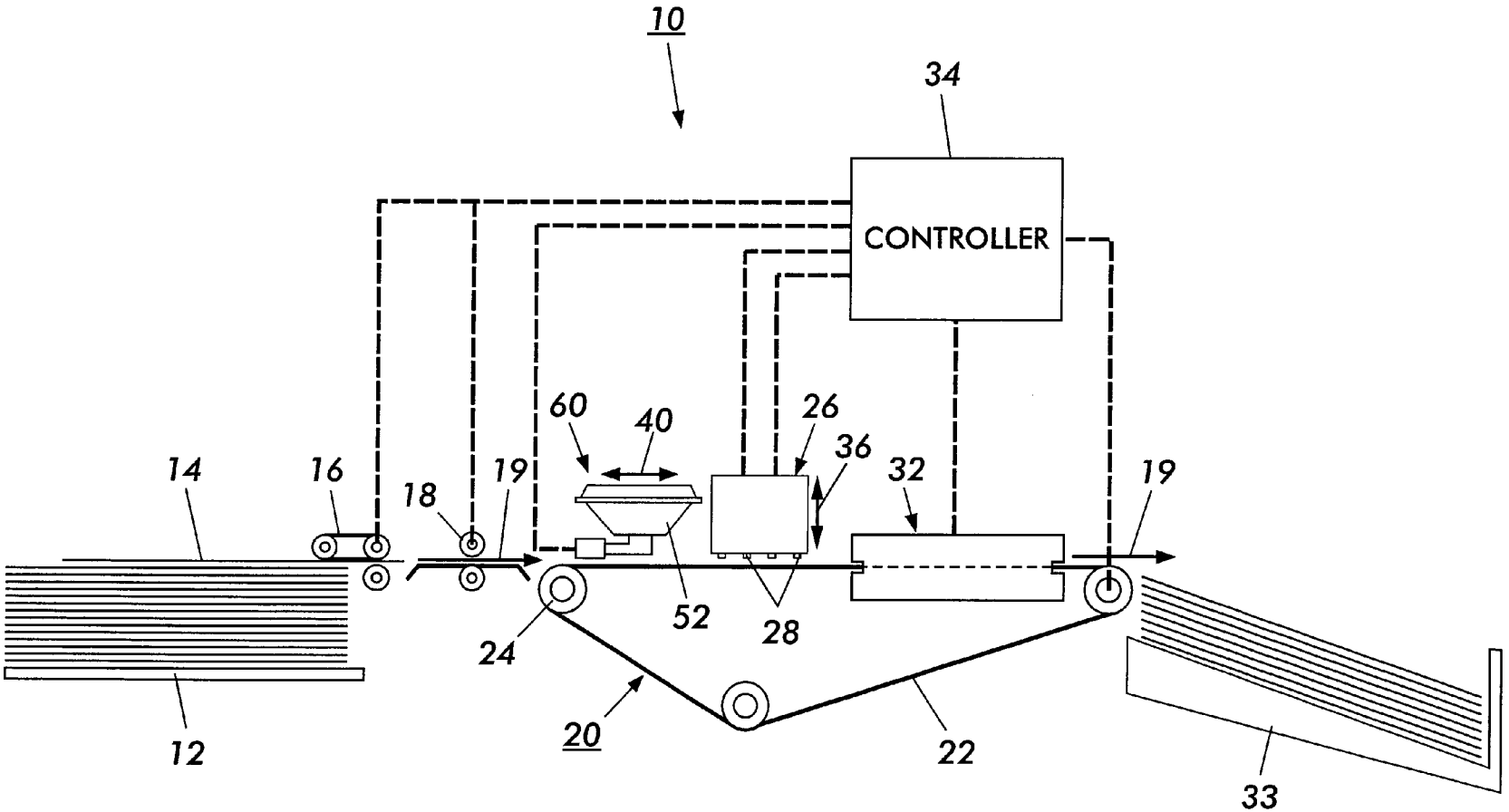
FIG. 1 is a schematic elevational view of a liquid ink printer including the ventable capping and priming assembly in accordance with the present invention.
Figure 2:
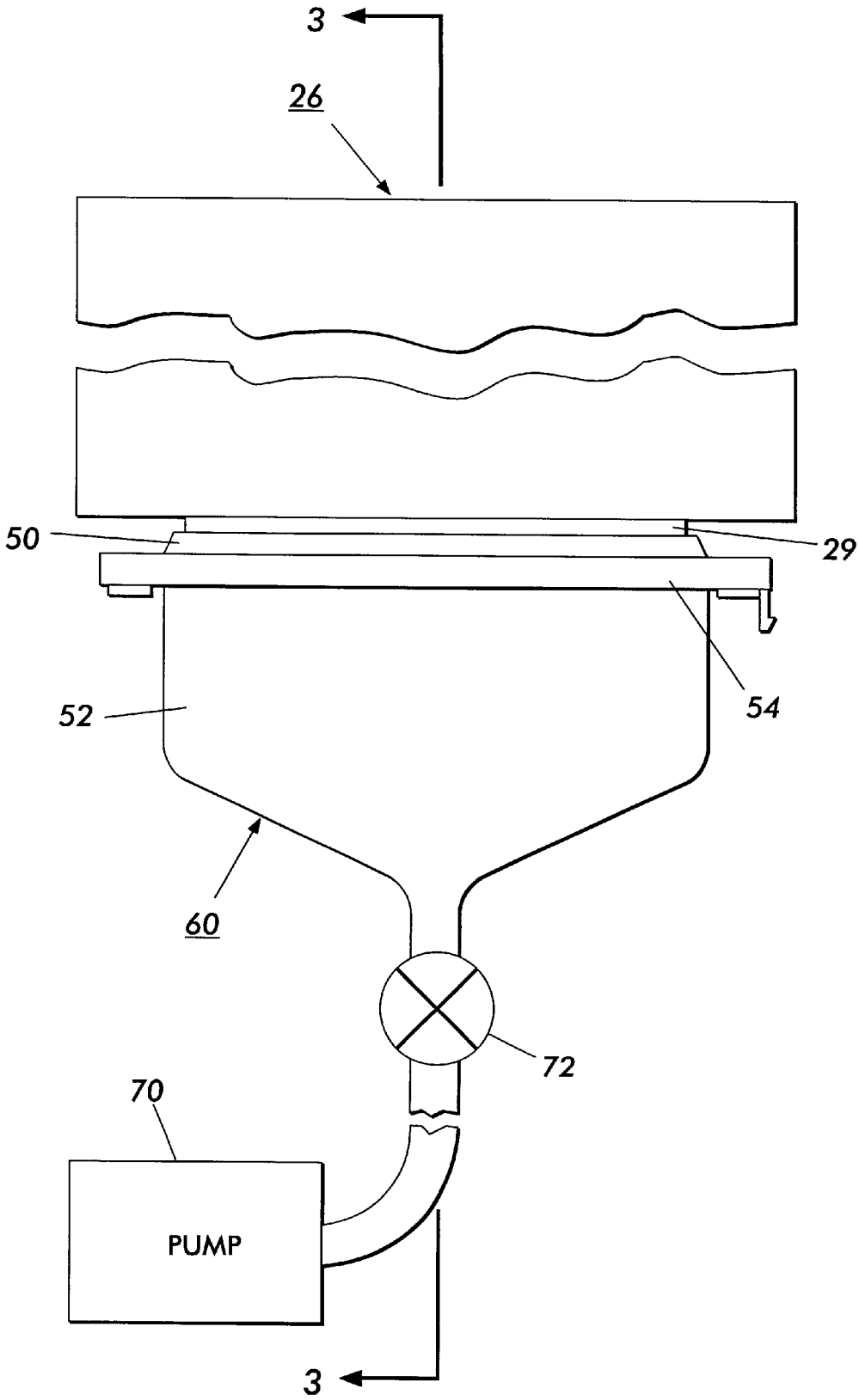
FIG. 2 is a schematic illustration of the ventable capping and priming assembly of the present invention in sealing engagement with the nozzle face of an ink jet printhead.
Figure 3:
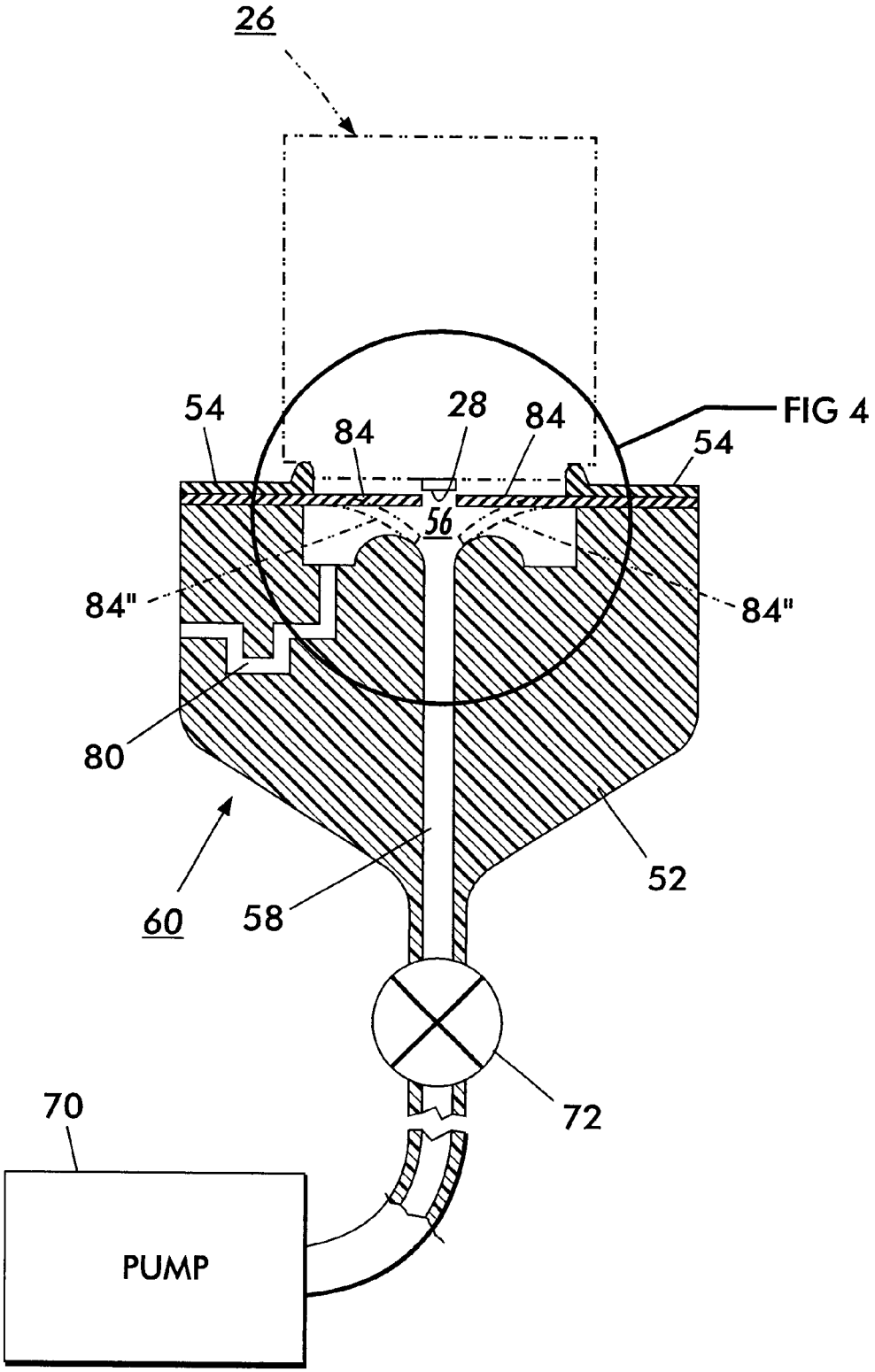
FIGS. 3 and 4 illustrates a vertical section of the ventable capping and priming assembly of the present invention in capped sealing engagement with the nozzle face of an ink jet printhead, showing its venting open position without vacuum, and its closed position during a priming operation under vacuum.
Figure 4:
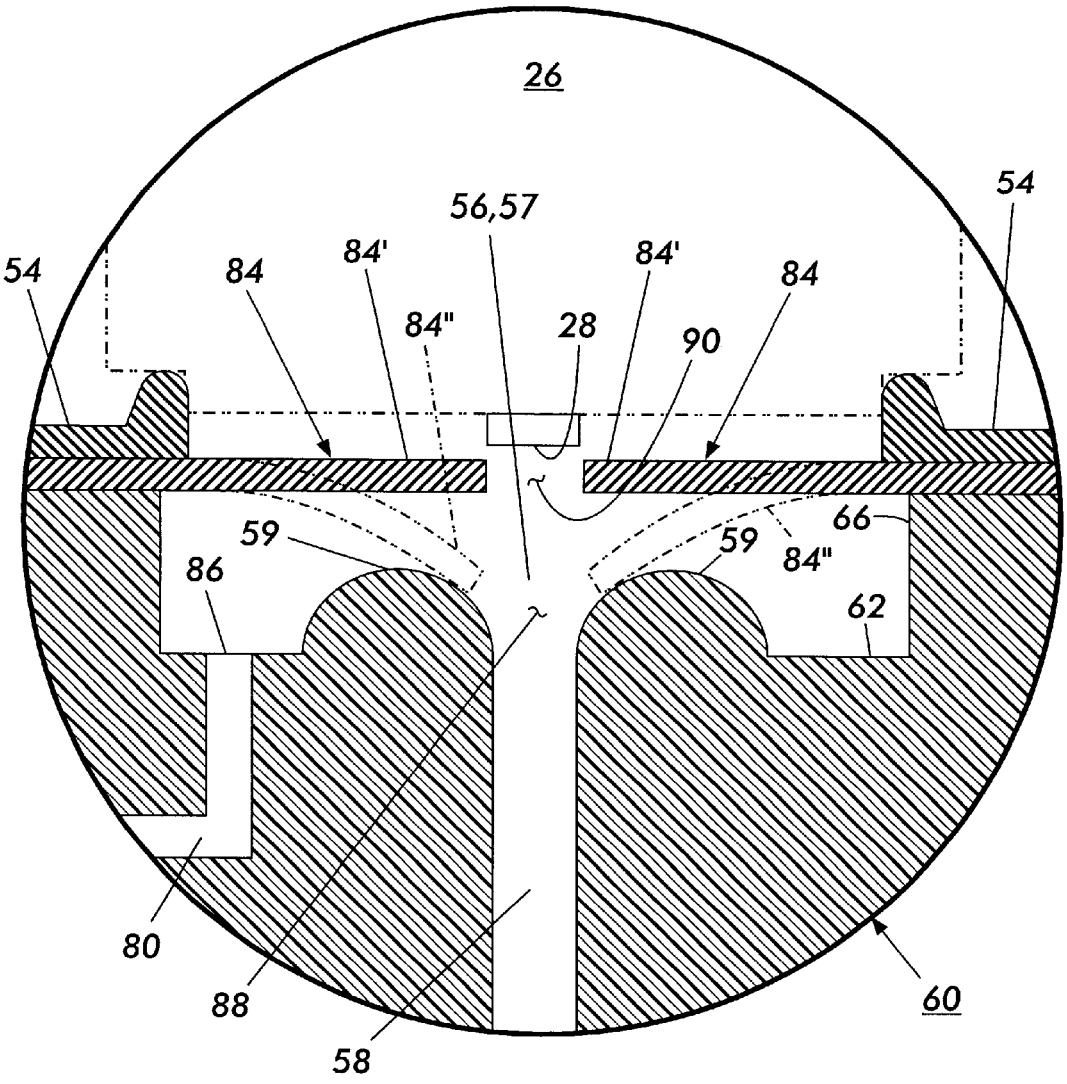

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to FIG. 1, there is shown a schematic elevational view of a liquid ink printer 10, for instance, an ink jet printer. As shown, the liquid ink or ink jet printer 10 incorporates the ventable printhead capping and priming assembly of the present invention, (to be described in detail below), and an input tray 12 containing sheets of a sheet of paper 14 to be printed upon by the printer 10. Single sheets of the sheet of paper 14 are removed from the input tray 12 by a pickup device 16 and fed by feed rollers 18 to a transport mechanism 20. The transport mechanism 20 moves the sheet by a feed belt or belts 22 driven by one of support rollers 24 beneath a liquid ink printhead assembly 26. The printhead assembly 26 as is well known, includes an ink supply (not labeled) attached for example to the printhead support or coupled to associated printheads through appropriate supply tubing.

The printhead assembly 26 includes printheads 28 which, for example, can be reciprocating printheads, or partial, or page width array, printheads supported in a printing position by a printhead support (not shown) in a confronting relation with the belt 22. During printing, the printheads 28 image-wise deposit droplets of liquid ink onto the sheet of paper 14 as it is carried by the belt 22 past and beneath the plurality of printheads 28. As is well known, each of the printheads 28 includes an array of print nozzles, for instance, staggered or linear arrays, having a length sufficient to image-wise deposit droplets of ink as above, within a printing zone that lies below the printheads and is crossed the sheet of paper 14. As the sheet of paper 14 is moved through the printing zone, the printheads 28 print or record a liquid ink image on the sheet of paper 14.

After printing or recording of the liquid ink image as above within the printing zone, the sheet of paper 14 is then carried by the belt 22 through a dryer assembly 32 for drying the liquid ink image thereon. From the dryer assembly 32, the sheet of paper 14, with a dried ink image thereon is moved to an output tray 33.

As shown, a controller 34 controls the operation of various aspects of the printer 10, including the transport mechanism 20, the dryer assembly 32 and the maintenance operation including the ventable capping and priming operation in accordance with the present invention. The transport mechanism 20 for example includes the pickup device 16, the feed roller 18, the belt 22 and the drive rollers 24. In addition, the controller 34 controls the movement of the printhead assembly 26, printing by the printheads 28 as would be understood by one skilled in the art. The controller 34 is preferably a self-contained, dedicated mini-computer having a central processor unit (CPU), electronic storage, and a display or user interface (UI). With the help of sensors and connections (not shown), the controller 34 reads, captures, prepares and manages the flow of data for the image being printed by the printheads 28. In addition, the controller 34 is the main multi-tasking processor for operating and controlling all of the other machine subsystems and printing operations.

At the completion of a printing job or when otherwise necessary, such as during a power failure, the printhead assembly 26, is moved away from the belt 22 in the directions of an arrow 36. A molded capping member 52 of the printhead ventable capping and priming assembly 60 of the present invention is moved beneath the printhead assembly 26, in the directions of the arrow 40 for capping the printheads of the printhead assembly 26. Once the printhead ventable capping and priming assembly 60 is positioned directly beneath the printhead assembly 26, the printhead assembly 26 is moved towards the belt 22 and into sealing engagement with a raised membrane 50 on the molded capping member 52 for capping, venting, and subsequently fully priming the printheads 28 in accordance with the present invention (to be described in detail below).

When the printhead assembly 26, has been capped, vented, and fully primed as above, and is again needed for another printing job, it is moved away from the belt 22 and the printhead ventable capping and priming assembly 60 is then moved away from the printhead assembly 26 such that the printhead assembly 26 can be repositioned appropriately with respect to the belt 22 for printing on the recording sheets 14.

Referring now to FIGS. 1–4, the printhead assembly 26 includes for example, a reciprocating printhead 28, that has been moved into a capping position against the printhead ventable capping and priming assembly 60 of the present invention. The printhead ventable capping and priming assembly 60 thus caps and seals against a nozzle face 29 of the printhead 28. As shown, the printhead ventable capping and priming assembly 60 comprises the raised membrane 50, preferably a low (20–30 shore "A") durometer silicone rubber joined to the molded capping member 52, having a substrate 54 and a recess 56. The recess 56 is shown with straight sides, but may be tapered inwardly, and terminates at a base 62 having an orifice into a vacuum path 58 therethrough.

As further shown, the molded capping member 52 includes the bottom wall 62, and side walls 64, 66 defining the priming chamber or recess 56, as well as, the vacuum path 58 from the vacuum device 70 into the chamber or recess 56. Because the nozzle face 29 is seated above the bottom wall 62, an enclosed priming gap 57 is formed within the chamber or recess 56. As illustrated, the enclosed priming gap 57 is thus defined by the nozzle face 29 of an ink jet printhead being capped, and by the bottom wall 62, side walls 64, 66 of the capping member 52, and a valve device 72 within the vacuum path 58.

The capping member 52 includes a first aperture or vacuum hole 88 and the collapsible membrane 84 includes a second aperture 90 that are arranged such that the first aperture 88 and the second aperture 90 are preferably aligned and communicating, thus defining a fluid flow path for air and ink to flow from the nozzle face 29 of the ink jet printhead being capped, into the priming recess 56, and vacuum path 58. As shown, the vacuum hole or aperture 88 preferably is located and centered within the priming recess 56. The relative sizes of the first opening 88 into vacuum path 58 and that of the second opening 90 through the collapsible membrane 84, are such as to enable the collapsible membrane 84 when in it collapsed position 84" to keep the hole 88 open while sealing off areas surrounding the hole 88.

The priming recess 56, and hence priming gap 57, include a raised convex portion 59 surrounding the opening, aperture or hole 88 into the vacuum path 58. The raised convex portion 59 is located at a suitable position for making sealing contact with the collapsible membrane 84 when the collapsible membrane is in its collapsed position 84". The enclosed priming gap 57 is formed after seating of the nozzle face 29, and prior to application of vacuum, and as such contains air.

Importantly, in accordance with the present invention, the capping member 52 of the ventable capping and priming assembly 60 includes a venting path 80 that is formed from an outside surface of the capping member, into the priming recess or chamber 57 for venting the nozzle face of the ink jet printhead being capped, thereby relieving such nozzle face defect causing capping pressures during non-priming periods. The venting path comprises a tortuous labryinthine passage through a body portion of the capping member 52 for maintaining moisture within the priming recess 56 as well as relieving the priming recess 56 and the nozzle face 29 of defect causing pressures during non-priming periods (that is periods when the nozzle face is capped and sealed but the vacuum device is not operating). The venting path 80 includes a venting hole or opening 86 that is located within the recess 56, (as well as within the enclosed priming gap 57), and that is peripherally spaced from the vacuum hole 88.

As further shown, the ventable capping and priming assembly 60 includes a collapsible membrane 84 that is mounted over the priming gap 57 and over the aperture or hole 86 into the venting path 80. The collapsible membrane 84 importantly is mounted in a cantilevered manner over the priming gap 57. As shown, collapsible membrane 84 has a normally open position 84' in which it is defining a connecting path from nozzle face 29 to the vacuum path 58, and importantly to the venting path 80. It also has a collapsed position 84", that is achievable under vacuum, in which it effectively seals against the raised convex portion 59 of the bottom wall 62, and thus closes off the connecting path between the nozzle face 29 and venting path 80.

For closing off the connecting path to the venting path 80, and then priming the nozzle face 29, a vacuum device such as a pump 70 and valve 72, are connected to the vacuum path 58 for applying a vacuum pressure through the vacuum path to the nozzle face 29. Such vacuum applied to the nozzle face 29, also is simultaneously applied to the collapsible membrane 84 for collapsing it from its normally open position 84' into its collapsed position 84" for sealing and closing off the venting path 80, while still exposing the vacuum path 58 for enabling application of the vacuum pressure against the nozzle face 29.

As can be seen, there has been provided a ventable capping and priming assembly for capping a nozzle face of an ink jet printhead so as to enable sealed priming of the printhead, as well as venting of the printhead to relieve defect causing pressures therefrom during non-priming periods. The ventable capping and priming assembly includes a capping member including a sealing member for sealing engagement with the nozzle face of the ink jet printhead, and a capping member mounted to the capping member and including a priming recess and a vacuum path formed therein. Further, the ventable capping and priming assembly includes a venting path formed from an outside surface of the capping member, and through the capping member, into the priming recess for venting the nozzle face of the ink jet printhead being capped, thereby relieving the nozzle face of the ink jet printhead of defect causing capping pressures.

While the embodiment disclosed herein is preferred, it will be appreciated from this teaching that various alternative, modifications, variations or improvements therein may be made by those skilled in the art, which are intended to be encompassed by the following claims.

What is claimed is:

1. A ventable capping and priming assembly for capping a nozzle face of an ink jet printhead so as to enable sealed priming of the printhead, as well as venting of the printhead to relieve defect causing pressures therefrom, the ventable capping and priming assembly comprising:

(a) a capping assembly including sealing means for sealing engagement with the nozzle face of the ink jet printhead;

(b) a capping member mounted to said sealing means and including a priming recess and a vacuum path formed therein;

(c) a venting path formed from an outside surface of said capping member, and through said capping member, into said priming recess for venting the nozzle face of the ink jet printhead being capped, thereby relieving the nozzle face of the ink jet printhead of defect causing capping pressures;

(d) a collapsible membrane mounted over said priming recess and over said venting path, said collapsible membrane having (i) a normally open position defining a connecting path from said vacuum path to said venting path and (ii) a collapsed position for closing off said connecting path while exposing said vacuum path; and (e) vacuum means connected to said vacuum path for applying a vacuum pressure through said vacuum path to the nozzle face of the ink jet printhead being capped, and to said collapsible membrane for collapsing said collapsible membrane from said normally open position into said collapsed position for sealing and closing off said venting path, and exposing said vacuum path for enabling application of said vacuum pressure against the nozzle face of the ink jet printhead being capped.

2. The ventable capping and priming assembly of claim 1, wherein said capping member includes a first aperture and said collapsible membrane includes a second aperture, said first aperture and said second aperture communicating and defining a fluid flow path for air and ink to flow from the nozzle face of the ink jet printhead being capped into said priming recess.

3. The ventable capping and priming assembly of claim 2, wherein relative sizes of said first opening through the collapsible membrane and said second opening into said vacuum path are such as to enable said collapsible membrane when in its collapsed position to keep the said second opening open while sealing off areas surrounding the second opening.

4. The ventable capping and priming assembly of claim 3, wherein said priming recess includes a raised portion surrounding said opening into said vacuum path.

5. The ventable capping and priming assembly of claim 4, wherein said raised portion is located at a suitable position for making sealing contact with said collapsible membrane when said collapsible membrane is in its collapsed position.

6. The ventable capping and priming assembly of claim 1, wherein said venting path comprises a tortuous labryinthine passage through a body portion of said capping member for maintaining moisture within said priming recess as well as relieving said priming recess and the nozzle face of the ink jet printhead being capped of defect causing pressures during non-priming periods.

7. The ventable capping and priming assembly of claim 2, wherein said vacuum path includes a vacuum hole located and centered within said priming recess.

8. The ventable capping and priming assembly of claim 1, wherein said venting path includes a venting hole located within said priming recess for relieving the nozzle face of the ink jet printhead being capped of defect causing pressures during non-priming periods.

9. The ventable capping and priming assembly of claim 1, wherein said vacuum path includes a vacuum hole located and centered within said priming recess.

10. The ventable capping and priming assembly of claim 9, wherein said venting path includes a venting hole located peripherally spaced from said vacuum hole.

11. An ink jet printer for printing a liquid ink image on a sheet of paper moving along a sheet path through a printing zone therein, the ink jet printing machine, including:

(a) a printhead mounted to said frame having a nozzle face and containing liquid ink for depositing image-wise onto the sheet of paper to form a liquid ink image; and (b) a ventable capping and priming assembly for capping said nozzle face of said printhead during a non-printing period of said ink jet printer so as to enable selective sealed priming of said printhead, as well as, venting of said printhead to relieve defect causing pressures therefrom, said ventable capping and priming assembly comprising:

(i) a capping assembly including sealing means for sealing engagement with said nozzle face of said printhead;

(ii) a capping member mounted to said sealing means and including a priming recess and a vacuum path formed therein;

(iii) a venting path formed from an outside surface of said capping member, and through said capping member, into said priming recess for venting said nozzle face of said printhead, thereby relieving said nozzle face and said printhead of defect causing capping pressures;

(iv) a collapsible membrane mounted over said priming recess and over said venting path, said collapsible membrane having (i) a normally open position defining a connecting path from said vacuum path to said venting path and (ii) a collapsed position for closing off said connecting path while exposing said vacuum path; and (v) vacuum means connected to said vacuum path for applying a vacuum pressure through said vacuum path to the nozzle face of the ink jet printhead being capped, and to said collapsible membrane for collapsing said collapsible membrane from said normally open position into said collapsed position for sealing and closing off said venting path, and exposing said vacuum path for enabling application of said vacuum pressure against the nozzle face of the ink jet printhead being capped.

12. The ink jet printer of claim 11, wherein said capping member includes a first aperture and said collapsible membrane includes a second aperture, said first aperture and said second aperture communicating and defining a fluid flow path for air and ink to flow from the nozzle face of the ink jet printhead being capped into said priming recess.

13. The ink jet printer of claim l2, wherein relative sizes of said first opening through the collapsible membrane and said second opening into said vacuum path are such as to enable said collapsible membrane when in its collapsed position to keep the said second opening open while sealing off areas surrounding the second opening.

14. The ventable capping and priming assembly of claim 13, wherein said priming recess includes a raised portion surrounding said opening into said vacuum path for making sealing contact with said collapsible membrane when said collapsible membrane is in its collapsed position.

15. The ink jet printer of claim 13, wherein said venting path comprises a tortuous labryinthine passage through a body portion of said capping member for maintaining moisture within said priming recess as well as relieving said priming recess and the nozzle face of the ink jet printhead being capped of defect causing pressures during non-priming periods.

16. The ink jet printer of claim 5, wherein said venting path includes a venting hole located within said priming recess for relieving the nozzle face of the ink jet printhead being capped of defect causing pressures during non-priming periods.

17. The ink jet printer of claim 5, wherein said vacuum path includes a vacuum hole located and centered within said priming recess.

18. The ink jet printer of claim 17, wherein said venting path includes a venting hole located peripherally spaced from said vacuum hole.

* * * * *